US008485503B2

(12) United States Patent
Lei

(10) Patent No.: US 8,485,503 B2
(45) Date of Patent: Jul. 16, 2013

(54) MULTI STREAM WINE AERATING DEVICE

(76) Inventor: Skip A. Lei, Portland, OR (US)

( * ) Notice: Subject to any disclaimer, the term of this patent is extended or adjusted under 35 U.S.C. 154(b) by 355 days.

(21) Appl. No.: 13/087,263

(22) Filed: Apr. 14, 2011

(65) Prior Publication Data

US 2012/0261844 A1 Oct. 18, 2012

(51) Int. Cl.
*B01F 3/04* (2006.01)

(52) U.S. Cl.
USPC ..... 261/76; 261/119.1; 426/474

(58) Field of Classification Search
USPC ..... 261/76, 119.1; 426/474; 99/323.1
See application file for complete search history.

(56) References Cited

U.S. PATENT DOCUMENTS

D624,358 S 9/2010 Maufette
2010/0011967 A1 1/2010 Barberio

FOREIGN PATENT DOCUMENTS

JP 02057567 A * 2/1990

OTHER PUBLICATIONS

Aerating Pour Spout, packaging material provided with an acrylic aerating pour spout purchased at a Safeway store in Portland Oregon Feb. 2011, shows a wine stopper with secure rubber stopper, strainer to blend in ozygen, dual vents to draw in oxygen, and angled spout.

* cited by examiner

*Primary Examiner* — Robert A Hopkins
(74) *Attorney, Agent, or Firm* — Sean Fitzgerald

(57) ABSTRACT

A wine aerating device that can be inexpensively manufactured and produced that aerates wine leaving a wine container, such as a long neck bottle, by separating the flow of wine into multiple streams of wine that retain the individual streams, whereby each stream of wine increases the surface area of wine exposed to the atmosphere, without injecting air into the wine. The device of the present invention also produces an esthetically pleasing pour while at the same time aerating the liquid by the use of multiple bi-directional tubes formed in a stopper that do not inject air into the wine.

20 Claims, 5 Drawing Sheets

MULTI STREAM WINE AERATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

This invention generally relates to a low cost device for aerating wine exiting from a container by breaking the flow of wine into multiple streams without injecting air into the wine.

Wine enthusiasts know that for certain wine, to truly enjoy the flavor, it must be allowed to "breath." That is, the wine must be exposed to the air. This breathing, or aeration, to be more precise, has been done by opening a selected container of wine, typically a bottle of wine, and allowing the wine sit and interact with the air. A problem with this method is that it takes time for the air to interact with the wine. The problem is even greater with a "box of wine." That is typically a flexible bag containing wine that had a resealable (multiple open and close) pour spout contained in a cardboard box. Such a wine box does not let air into the container to breath so it is important to aerate wine exiting the wine box container.

An excellent discussion of previous attempts to aerate wine can be found in US 2010/0011967 A1, which is hereby incorporated by reference for the discussion of the need to aerate wine, and the drawbacks of known methods and devices that inject air into wine in a container.

Other attempts to inject air into wine have been used, such as U.S. Design Pat. No. D614443 which shows a stopper having one tube of changing diameter for wine to pour out of a bottle that is designed to use the Venturi effect of a fluid moving through a compressed space and then into an expanded space. Formed into the tube in which the wine flows is an air intake that injects air into the wine as it flows past the constricted portion of the pouring tube. The same air supply line also is directed into the bottle end of the stopper so that air is fed back into the bottle as wine leaves the bottle.

Another attempt to aerate wine is the Aerating Pour Spout sold by True Fabrication™ of Seattle Wash. This device also has a single tube with changing diameter extending through the stopper to allow wine to exit a bottle, and also has a narrow portion to create a Venturi effect before it expands out to meet a metal plate with a plurality of holes in it defined as a "strainer [that] blends in oxygen." This device has "dual vents" that draw in oxygen as a result of the Venturi effect.

These known examples of wine aerators inject air into wine via a Venturi effect, the same effect widely used in engineering applications, for example to mix air and fuel in carburetors. While this may be fine for fuel in carburetors, they are too harsh on the wine and therefore do not produce the pleasing effect of natural aeration, that is the air moving over the surface of the wine.

BRIEF SUMMARY OF THE INVENTION

The disclosed apparatus relates to a device for controlling the flow of a liquid from a container, such as a bottle, having a narrow cylindrical opening through which wine or similar liquid may be poured. One aspect of this invention is directed to a low cost aeration device for aerating wine as it is poured from a bottle or exits a box of wine. Another aspect of the invention is to maximize the surface area of the wine exposed to the air, or atmosphere, as it is poured, without injecting air into the wine. A further aspect of the invention is to make an aerating device that is customizable by an end user.

The device is generally a stopper that either fits into the mouth of a bottle and is retained by a friction fit, or screws onto the top of a bottle that has a screw on top rather than a cork, or has been designed into the end of a pour spout attached to a flexible bag that contains a liquid, such as wine. The stopper can be made of any material that does not impact the flavor of the wine. It may be metal, plastic, rubber, cork, acrylic or a combination of these materials. The stopper includes one end region to be placed in fluid communication with the wine in a bottle or pour spout of a flexible bag holding wine, and an opposite end region exposed to the atmosphere to be in fluid communication with the atmosphere. A plurality of elongated tubes, each of a constant diameter from one end to the other, are held or formed within the stopper, and extend from the region to be placed in fluid communication with the wine to the end in communication with the air. In one embodiment at least one of the tubes can be manipulated by a user to slide in or out of the stopper to increase or decrease the projection of the tube from a top surface or bottom surface of a stopper.

In a preferred embodiment of the device, there are at least 3 elongated conduits, or tubes, located intermediate the end regions of the stopper. As used here, tubes has its standard definition of a hollow, usually cylindrical body of metal, glass, rubber, acrylic or other material, used especially for conveying or containing liquids or gases. However, the tubes can be of any shape as long as that shape is maintained from one end to the other so as not to product or induce a Venturi effect on the wine. With the preferred circular straw type of tube, each tube has a constant diameter so that there is no Venturi effect on the wine as it flows through the tube to the open end of the tube and into the atmosphere. Wine entering the fluid communication end of the device contacts the opening to the tubes. Using only the force of gravity, the wine contacting the opening in the tubes experiences a gentle separation so that the delicate wine is not damaged. Each stream passes through its own elongated tube and exits the end region exposed to the air. The number of streams greater than 3 is limited only by the diameter of the tubes and the diameter of the device, which should be set to the diameter of the mouth of a standard wine bottle, the pour spout of boxed wine. The greater the number of tubes, the smaller the diameter of each tube. However, it is also possible to make the tubes with one or more having a larger or smaller diameter than the others. For example, one tube may be designed to have a larger diameter than the others. The one tube with the larger diameter may be placed in the center of the stopper, or it may be positioned other than the center of the stopper. It is all a matter of design fitting them inside the mouth, or opening of the wine bottle, or the pour spout, and the desired visual effect that is to be achieved by the resulting streams of wine.

In another embodiment, the ends of one or more of the tubes can be extended beyond the end of the stopper to be in communication with the wine such that the tubes extend into the bottle beyond the end of the stopper. These tubes can either be fixed in position at the time of manufacture, or designed to slide such that a user can adjust the length of the tube beyond the end of the stopper.

In addition, one or more of the ends of the tubes that are in fluid communication with the atmosphere can be extended beyond the end of the stopper so that they project from the mouth of the bottle or pour spout. Here again, the tubes can be manufactured in this extended position, or they can be designed to be moveable so that the length of the projection can be adjusted by a user to customize the visual experience created when a fluid exits the tubes.

These ends of the tubes projecting to communicate with the atmosphere may be individual tubes projecting out from the stopper, or may be tunnels formed in a solid piece, such as clear plastic (Acrylic), so that the wine can be seen as it travels from a bottle, and exits the tubes as individual streams.

Once placed on a bottle of wine, the wine bottle is tilted such that the wine under the force of gravity contacts the tubes and exits the bottle as individual streams of wine. Each stream of wine increases the surface area of the wine exposed to the air. The greater the number of tubes the greater the number of streams of wine, and therefore the greater the surface area of wine exposed to the air. This is a more natural and desirable form of aeration than those methods or devices that inject air into the wine.

When the desired amount of wine has been dispensed, tipping the bottle to its natural resting position will stop the gravity powered flow of wine out of the bottle. The remaining wine in the tubes will be retrieved back into the bottle for storage (until the next pour).

A unique feature of this invention is that each tube is bi-directional. That is, each tube can serve as either an exit path for the fluid leaving the bottle, or an air intake to let air back into the bottle to replace the volume of fluid leaving the bottle. Unlike other solutions that provide for dedicated air intake ports, and thus limit how the bottle can be tilted, applicant's invention can be poured from any side. In this manner, a tube that in the first pour served to be a fluid transmitting tube may in the second pour become an air transmitting tube.

In the case of a pour spout attached to a flexible bag containing wine (eg, a "box of wine") there is no need for an air intake to let air back into the bag. Therefore, each tube serves as an exit path for the wine and each tube produces a stream of wine that is then aerated by the atmosphere surrounding each stream.

In addition, each stream from each tube creates an elegant and visually stimulating experience for the user as the wine is gently aerated. If the tubes are parallel, the streams remain separated as gravity pulls on them as they are directed into a glass or other useful container. If manufactured with non-fixed tubes, tubes that can for example slide within the stopper, then the length of the tubes can be adjusted to change or customize the visual experience as the wine is aerated. With a little engineering, the ends of the tubes can be angled so that the streams of wine from the tubes will converge back into a mixed stream. The collision of the streams should be at a very slight angle so that the streams merge without excessive spray.

In one embodiment, the stopper portion of the device is designed to fit into the neck of a bottle. One such means is an annular mounting flange for mounting within a neck of the bottle with a friction fit to support the device in a stable position on the bottle. This preferably is a semi ridged material, such as cork or rubber that forms the bottom portion of the stopper, or is wrapped around the bottom portion of the stopper. An alternative means is a threaded coupler that can screw onto the top of a wine bottle that is formed to receive a screw top. With the growing popularity of box wines (flexible bags of wine with resealable pour spouts that may be distributed and sold either as bags, or as bags inside of protective cardboard boxes from which the name "box" wine derives), the present invention can either be designed and manufactured right into the resealable pour spout, or designed to be added on by a consumer with a reusable aerating stopper of the present invention.

In one embodiment, the tubes are all of the same diameter. In another embodiment, at least one tube has a larger diameter than the other tubes. With a larger diameter, it is possible to make a telescoping tube with tubes of smaller diameter fitted inside the tube of larger diameter whereby the inner tube could be pulled out, or pushed in to customize the length of the tube.

In one embodiment, the tubes are all of the same length. In another embodiment, at least one tube is longer than the other tubes. It may be manufactured in a fixed position, or, by design, can be adjusted within the stopper to be longer or shorter than the other tubes.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
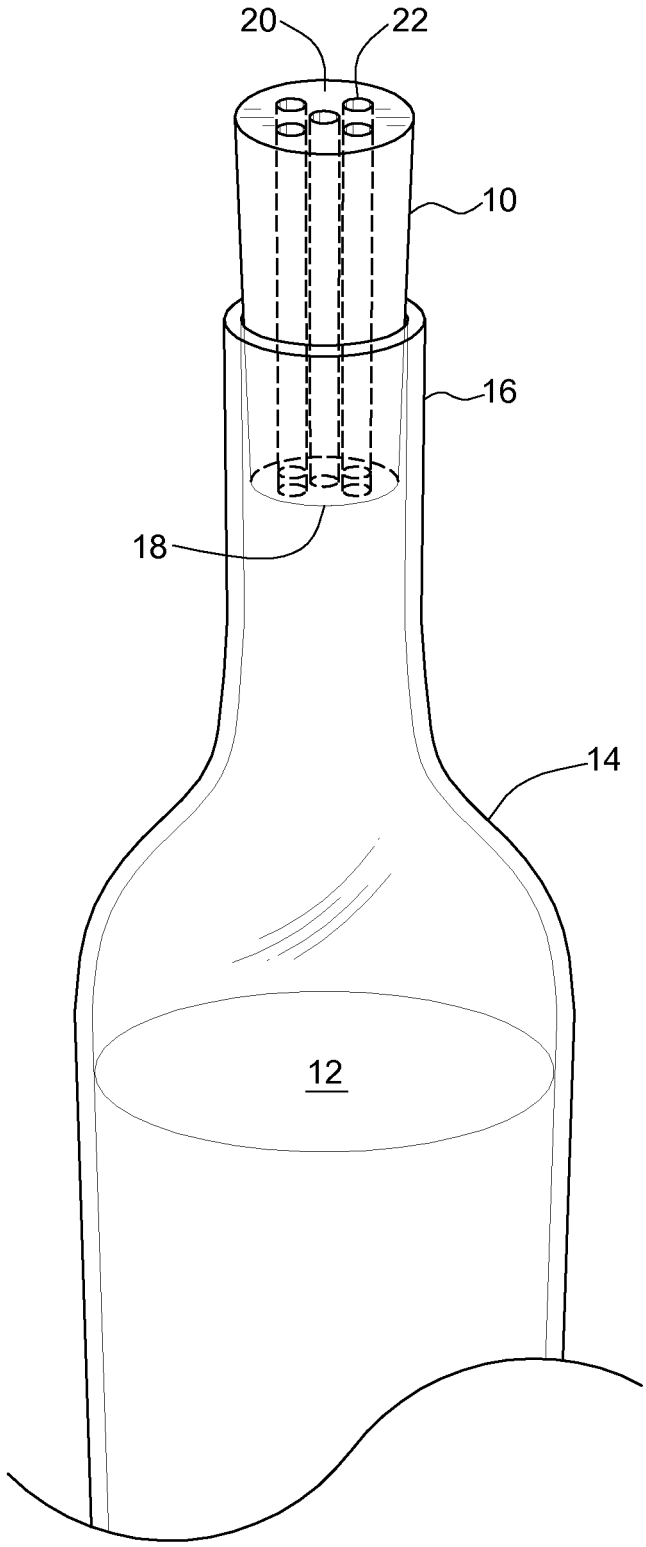
FIG. 1 is perspective view showing the aeration device in accordance with this invention mounted on a wine bottle in the vertical position.

Referring now to the drawings, in particular FIG. 1, reference numeral 10 generally identifies a portable aeration device for aerating wine 12 in a bottle 14 having a neck 16. The device 10 (300 in FIG. 3, 400 in FIG. 4) is generally a stopper that either fits into the mouth of a bottle (FIGS. 1 and 2) and is retained by a friction fit, or screws onto the top of a bottle (FIG. 5) that has a screw on top rather than a cork, or has been designed into the end of a pour spout (FIG. 7) attached to a flexible bag that contains a liquid, such as wine. The stopper includes one end region, or bottom surface 18 to be placed in fluid communication with the wine 12 in a bottle 14, or pour spout 710 (FIG. 7) of a flexible bag 720 holding wine, and an opposite end region, or top surface 20 exposed to the atmosphere to be in fluid communication with the atmosphere. A plurality of elongated tubes 22, each of a constant diameter from one end to the other, are held or formed within stopper 10, and extend from the bottom surface 18 to the top surface 20. Tubes that are not formed within the stopper may be releasably held within the stopper by friction such that an end user may adjust the projection of a tube beyond the bottom or top surfaces. Or such tubes may be telescopic, in that they may be designed to extend in or out by sliding within a larger tube, or movable within a stopper.

Figure 2:
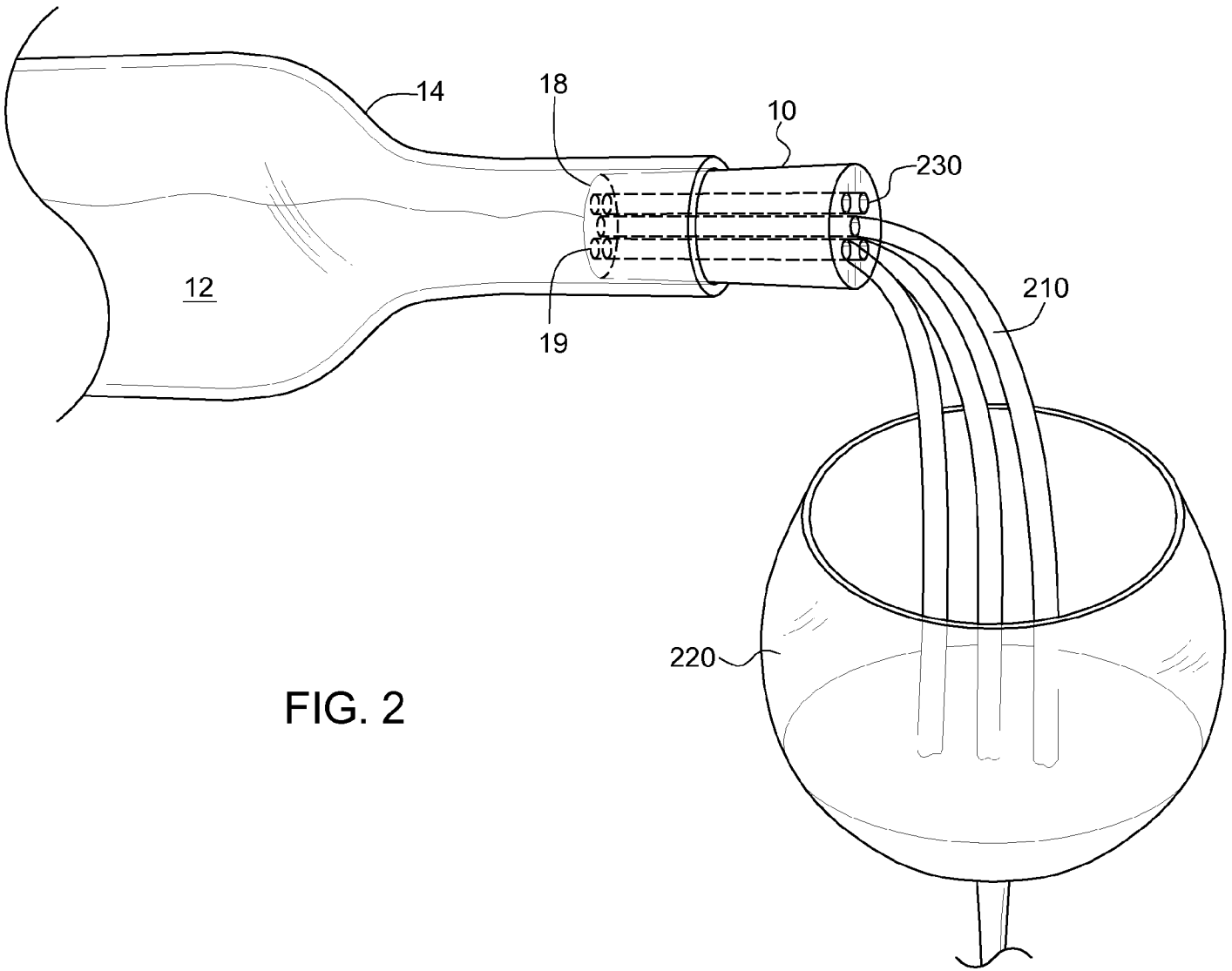
FIG. 2 is perspective view showing the aeration device in accordance with this invention mounted on a wine bottle in the horizontal position.
Figure 3:
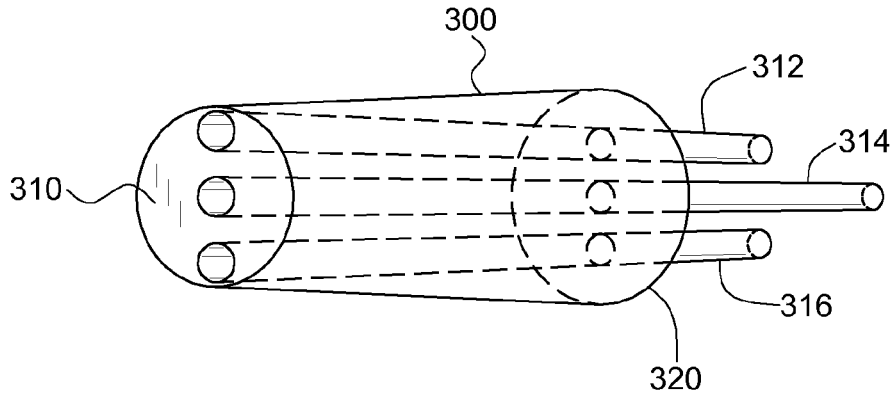
FIG. 3 is a perspective view of the aeration device in accordance with this invention having tubes that project from the top surface of the device.

In a preferred embodiment of the device, as shown in FIG. 3, stopper 300 has at least 3 elongated conduits, or tubes 312, 314, 316, located intermediate the bottom surface 310 and the top surface 320 of stopper 300. As used here, tubes has its standard definition of a hollow, usually cylindrical body of metal, glass, rubber, acrylic or other material, used especially for conveying or containing liquids or gases. With the preferred circular straw type of tube (312, 314, 316), each tube has a constant diameter so that there is no Venturi effect on the wine as it flows through the tube to the open end of the tube and into the atmosphere, as shown in FIG. 2. Eliminating, or greatly reducing the Venturi effect stops or greatly reduces air being injected into the wine so that aeration occurs due to air on the surface area of wine that exits via the tubes.

Figure 7:
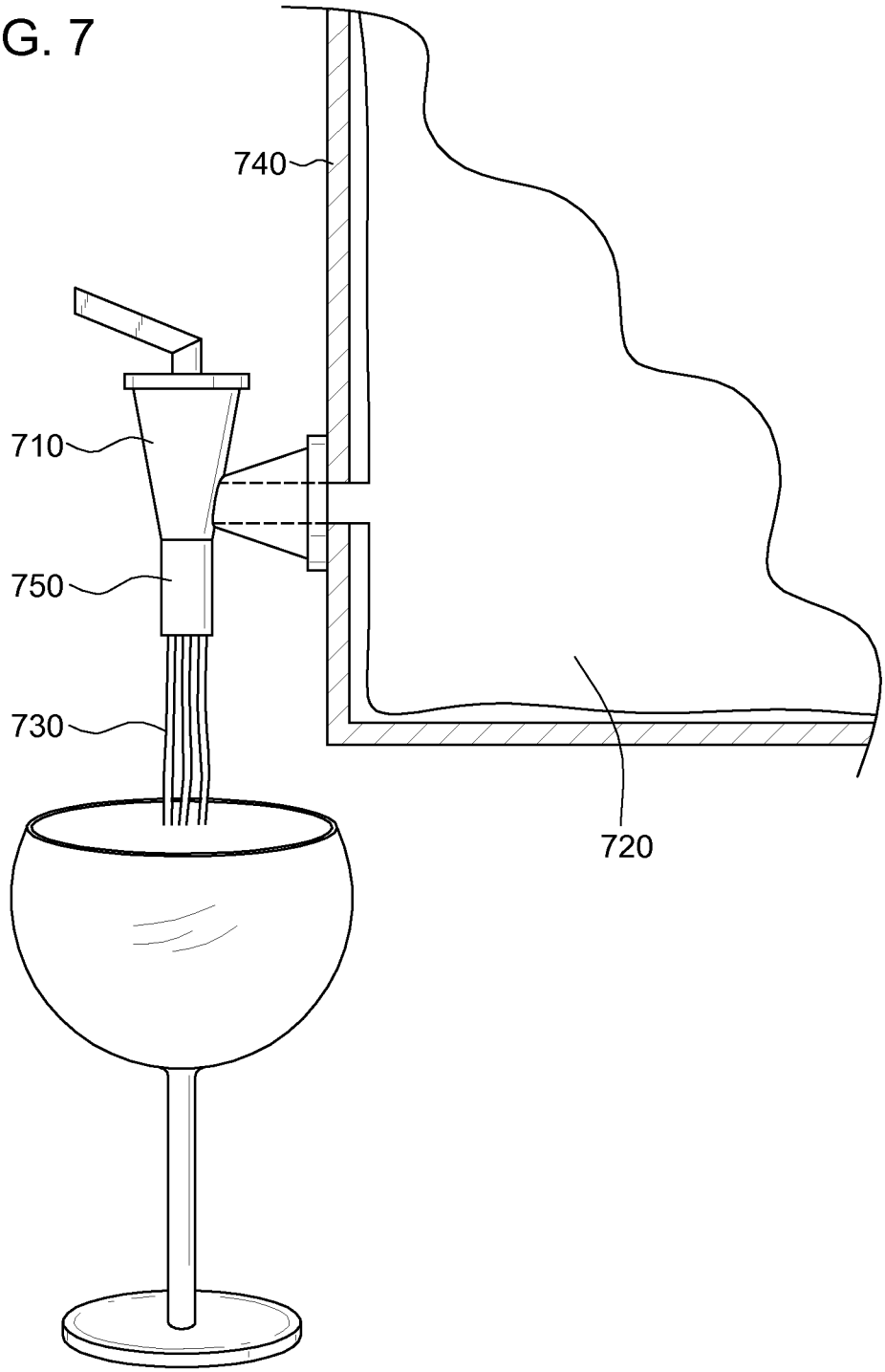
FIG. 7 is a partial perspective view of the multi stream aeration device in accordance with this invention as part of a pour spout of a wine box.

Turning to FIG. 2, wine entering the fluid communication end of the device, bottom surface 18, contacts the opening 19 to the tubes 22. Using only the force of gravity, the wine contacting the opening in the tubes in the end region of stopper 10 experiences a gentle separation into streams 210 so that the delicate wine is not damaged. Each stream 210 passes through its own elongated tube 22 and exits the end region, top surface 20, to be exposed to the air. The number of streams greater than 3 is limited only by the diameter of the tubes 22 and the diameter of the device 10, which should be set to the diameter of the mouth of a standard wine bottle 14, or the pour spout of boxed wine (FIG. 7). The greater the number of tubes 22, the smaller the diameter of each tube.

Figure 6:
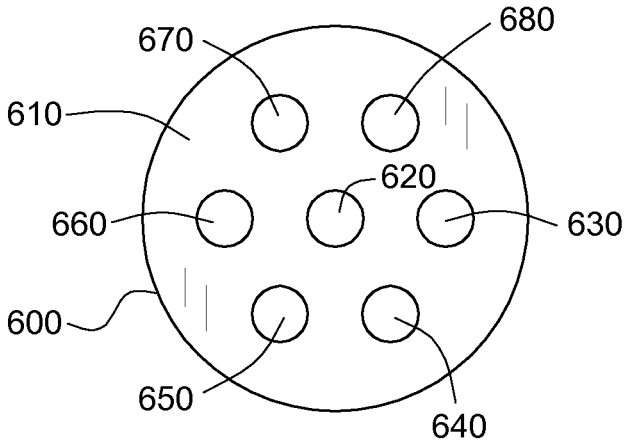
FIG. 6 is a top view of the aeration device in accordance with this invention having 7 tubes.

As for example, shown in FIG. 6 is a top view of one embodiment of a stopper 600 having seven tubes 620, 630, 640, 650, 660, 670, and 680. In this embodiment, one tube 620 is placed in the center of stopper 600, while the remaining tubes 630, 640, 650, 660, 670, and 680 are positioned equally spaced around tube 620. Alternatively, by design the tubes could be arranged in, by way of example, and not as a limitation, an "S" pattern so that when streams of wine are poured they may form a desired pattern. Or they can be randomly positioned.

It is also possible to make the tubes 22, 620, 630, 640, 650, 660, 670, and 680 with one or more having a larger or smaller diameter than the others. For example, one tube may be designed to have a larger diameter than the others as is shown in FIG. 4.

Figure 4:
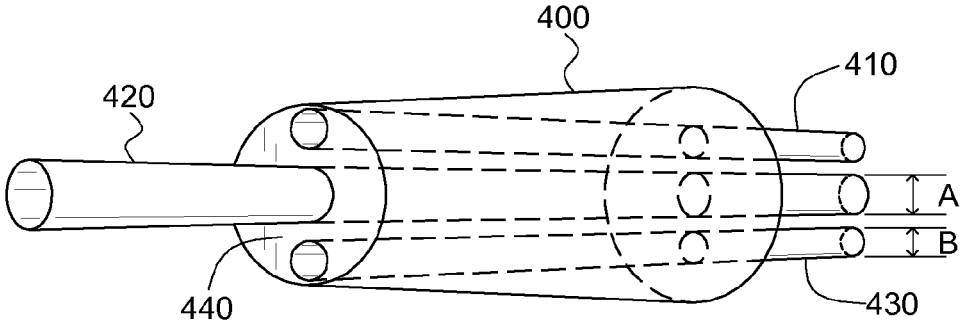
FIG. 4 is a perspective view of the aeration device in accordance with this invention having a tube that project from the bottom surface of the device.
Figure 5:
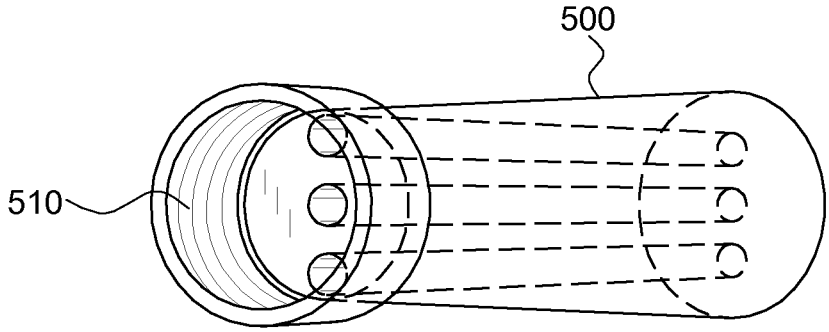
FIG. 5 is a perspective view of the aeration device in accordance with this invention having a screw cap on the bottom surface of the device.

Turning to FIG. 4, there is shown one embodiment of the invention, stopper 400, having three tubes 410, 420, 430. Tube 420 has a diameter "A" that is larger than tube 430 with diameter "B." While tube 420 with the larger diameter is shown placed in the center of the stopper 400, it may also be positioned anywhere other than the center of the stopper. It is all a matter of design choice, and the desired visual look of the pattern of streams 210 (FIG. 2) to produce the desired visual effect that is to be achieved by the resulting streams of wine. Tubes with larger diameters can be designed to hold within them a tube of smaller diameter (not shown) that can telescope out or in to allow for customization of the stopper 400. Or at least one of tubes 410, 420, 430 can be moveable within stopper 400 to allow customization of stopper 400.

Also, as shown in FIG. 4, the ends of one or more of the tubes 410, 420, 430 can be extended beyond the end of the stopper 400, bottom surface 440, such that the tubes (as shown tube 420) extends beyond the ends of tubes 410 and 430. When in use on a wine bottle (such as wine bottle 14 shown in FIGS. 1 and 2) tube 420 would extend into the bottle beyond the end, or bottom surface 440 of stopper 400.

In addition, as shown in FIG. 3, one or more, or all of the ends of the tubes 312, 314, 316 that are in fluid communication with the atmosphere can be extended beyond the top end of stopper 300 (top surface 320) so that they will project from the mouth of the bottle 14 or pour spout 710. Also as shown in FIG. 3, the tubes 312, 314 and 316 can be of different lengths (tube 314 being shown as longer than the remaining tubes. The length of the tubes is a design choice for the visual display of the streams that will exit the stopper. Again, at least one of the tubes can be moveable within stopper 400 to allow customization of stopper 400. In this way a consumer may determine which tube should project more that the other tubes.

Turning again to FIGS. 1 and 2, once stopper 10 has been placed on bottle 14 of wine 12, the wine bottle 14 may be tilted in any direction (north, south, east, west) such that the wine under the force of gravity contacts the tubes 22, enters the tubes in opening 19 and exits the tubes of stopper 10 as individual streams 210 of wine. Each stream of wine increases the surface area of the wine exposed to the air. The greater the number of tubes 22 the greater the number of streams 210 of wine, and therefore the greater the surface area of wine exposed to the air. This is a more natural and desirable form of aeration than those methods or devices that inject air into the wine.

When the desired amount of wine has been dispensed, returning the bottle to its natural resting position (FIG. 1) will stop the gravity powered flow of wine out of the bottle. The remaining wine in the tubes 22 will be retrieved back into the bottle for storage (until the next pour).

A unique feature of this invention is that each tube 22 is bi-directional. That is, each tube 22 can serve as either an exit path for the fluid leaving the bottle 14, or an air intake to let air back into the bottle 14 to replace the volume of fluid leaving the bottle 14. Other solutions in the art provide for dedicated air intake ports, and thus limit how the bottle can be tilted (eg, there is only one way to pour so that the bottle must be held and poured in one particular direction so that the air intake will function correctly). Applicant's invention can be poured from any side of stopper 10 (300, 400, 500) In this manner, a tube 22 that in the first pour served to be a fluid transmitting tube out of the bottle 14 may in the second pour become an air transmitting tube into the bottle 14. As shown in FIG. 2, three of five tubes 22 are transmitting wine 12 as streams 210 from bottle 14 into container 220, while two of the five tubes 230 are transmitting air back into the bottle 14. If the pour had been made to the left side of the bottle 14 (FIG. 1), tubes 230 could transmit wine 12 into container 220, while tubes 22 that had been transmitting wine 12 to container 220 could be transmitting air into bottle 14.

Turning to FIG. 7, in the case of a pour spout 710 attached to a flexible bag 720 containing wine (eg, a "box of wine") there is no need for an air intake to let air back into the sealed bag 720 as the bag deflates as wine exits the bag. There is no vacuum created by the volume of wine leaving the bag. Therefore, each tube serves as an exit path for the wine and each tube produces a stream 730 of wine that is then aerated by the atmosphere surrounding each stream 730.

In addition, as shown in FIG. 2 and FIG. 7 each stream (210 in FIG. 2, 730 in FIG. 7) from each tube creates an elegant and visually stimulating experience for the user as the wine is gently aerated by air passing over the surface of the wine, rather than injecting air into the wine. If the tubes are parallel as shown in all Figs, the streams remain separated as gravity pulls on them as they are directed into a glass 220 or other useful container. With a little engineering, the ends of the tubes 22, can be angled so that the streams 210 of wine from the tubes will converge back into a mixed stream (not shown). Such collision of the streams should be at a very slight angle so that the streams merge without excessive spray, or bruising of the wine.

In one embodiment, as shown in FIGS. 1, 2, 3 and 4, the bottom portion of stopper 10, 300, 400, is tapered and designed to fit into the neck of a bottle as is well known for bottle stoppers or corks. Stopper 10, 300, 400 fit within a neck of the bottle with a friction fit to support the stopper in a stable position on the bottle 14. The portion of stopper 10, 300, 400 that provides the friction fit inside the neck 16 of bottle 14 preferably is a semi ridged material, such as cork or rubber that is wrapped around the bottom portion of the stopper. An alternative means to connect the invention is a threaded coupler 510 of stopper 500 shown in FIG. 5. Stopper 500 can be screwed onto the top of a wine bottle that is formed to receive a screw top. Once only for inexpensive wines, screw on caps are becoming more prevalent in the wine industry due to issues with cork.

With the growing popularity of box wines (flexible bags of wine 720 with resealable pour spouts 710 that may be distributed and sold either as bags, or as bags inside of protective cardboard boxes 740 from which the name "box" wine derives), the present invention (stopper 750) can either be designed and manufactured right into the resealable pour spout, as shown in FIG. 7, or designed to be added on by a consumer with a reusable aerating stopper of the present invention having the proper connection end designed as part of a stopper. Applicant makes no claim to the means used to connect the present invention to the source of the wine. Any appropriate means to make a connection will suffice, from friction fittings, to screw on fittings like a screw on bottle cap, to being manufactured into the end of a pour spout for use in wine dispensing bags, jugs, barrels or boxes, or given releasable connection means to attach the present invention to of a pour spout for use in wine dispensing bags, jugs, barrels or boxes, such as by way of a snap, or strap, or friction fit.

While the invention has been illustrated and described as embodied in a wine aeration device, it is not intended to be limited to the details shown since various modifications and structural changes may be made without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. An apparatus for aerating wine from a wine bottle, comprising:

a stopper having a plurality of tubes extending from a top surface of the stopper through a bottom surface of the stopper;

said stopper having means to connect said stopper to a wine bottle; and said plurality of tubes each having an internal diameter that is substantially constant from one end to the other, and each being bi-directional such that each tube is capable of transmitting wine from the wine bottle or transmitting air from atmosphere into the wine bottle, whereby when connected to a wine bottle with wine inside and the wine bottle is tilted, at least one of the tubes will transmit air into the wine bottle while the remaining tubes will transmit wine as independent streams of wine to the atmosphere.

2. An apparatus as recited in claim 1 whereby at least one tube extends beyond the bottom surface of the stopper.

3. An apparatus as recited in claim 1 whereby at least one tube extends beyond the top surface of the stopper.

4. An apparatus as recited in claim 1 whereby the plurality of tubes all have a same internal diameter.

5. An apparatus as recited in claim 1 whereby at least one of the plurality of tubes has an internal diameter different from the rest of the plurality of tubes.

6. An apparatus as recited in claim 1 whereby the plurality of tubes is 3.

7. An apparatus as recited in claim 1 whereby the plurality of tubes is 5.

8. An apparatus as recited in claim 1 whereby the plurality of tubes is 7, with one tube positioned in the center of the stopper surrounded by the remaining 6 tubes equally spaced from each other.

9. An apparatus as recited in claim 1 whereby one tube is positioned in the center of the stopper.

10. An apparatus as recited in claim 9 whereby the one tube positioned in the center of the stopper is longer than the remaining tubes.

11. An apparatus as recited in claim 1 whereby the means to connect the stopper to the wine bottle a friction fit inside a mouth of the wine bottle.

12. An apparatus as recited in claim 1 whereby the means to connect the stopper to the wine bottle is a screw on member.

13. An apparatus for aerating wine from a wine bottle, comprising:

a stopper having at least 3 tubes extending from a top surface of the stopper through a bottom surface of the stopper;

said stopper having means to connect said stopper to a wine bottle; and said tubes each being bi-directional such that each tube is capable of transmitting wine from the wine bottle or transmitting air from atmosphere into the wine bottle, whereby when connected to a wine bottle with wine inside and the wine bottle is tilted, at least one of the tubes will transmit air into the wine bottle while the remaining tubes will transmit wine as independent streams of wine to the atmosphere.

14. An apparatus as recited in claim 13 further having at least one tube that is held within the stopper whereby said tube is moveable to extend beyond the bottom surface of the stopper more than the other tubes extend beyond the bottom surface of the stopper.

15. An apparatus as recited in claim 13 further having at least one tube held within the stopper whereby said tube is moveable to extend beyond the top surface of the stopper.

16. An apparatus as recited in claim 13 whereby the tubes all have a same internal diameter.

17. An apparatus as recited in claim 13 whereby one of the tubes has an internal diameter larger than the rest of the tubes.

18. An apparatus as recited in claim 13 whereby one of the tubes is positioned in the center of the stopper.

19. An apparatus as recited in claim 13 whereby one of the tubes has an internal diameter larger than the rest of the tubes, and is positioned other than in the center of the stopper.

20. An apparatus for aerating wine from a flexible bag container having a resealable pour spout, comprising:

a stopper having a plurality of tubes extending from a top surface of the stopper through a bottom surface of the stopper;

said stopper connected to the resealable pour spout; and said plurality of tubes each having an internal diameter that is substantially constant from one end to the other, with each tube capable of transmitting wine from the flexible bag container, whereby when wine is released via the resealable pour spout the tubes will transmit wine as independent streams of wine to the atmosphere.

* * * * *